US005749153A

United States Patent [19]

Viens

[11] Patent Number: 5,749,153

[45] Date of Patent: May 12, 1998

[54] WALLBOARD T-SQUARE WITH SHARPENER

[76] Inventor: Raymond J. Viens, 10 Birch Dr., Corning, N.Y. 14830

[21] Appl. No.: 528,024

[22] Filed: Sep. 14, 1995

[51] Int. Cl.[6] ..... B43L 7/02

[52] U.S. Cl. ..... 33/474; 33/42; 33/485

[58] Field of Search ..... 33/474, 535, 479, 33/770, 42, 760, 32.1, 41.1, 484, 485; 76/82, DIG. 9

[56] References Cited

U.S. PATENT DOCUMENTS

| | | | |
|---|---|---|---|
| 180,521 | 8/1876 | Beach | 33/485 |
| 501,774 | 7/1893 | Dunnington | 33/32.2 |
| 685,369 | 10/1901 | Barrie | 33/479 |
| 996,242 | 6/1911 | Heinzman | 76/82 |
| 1,555,653 | 9/1925 | Frank | 33/485 |
| 4,075,467 | 2/1978 | Peterson | 33/474 |
| 4,903,409 | 2/1990 | Kaplan et al. | 33/42 |
| 4,979,304 | 12/1990 | Sprague | 33/42 |
| 5,040,256 | 8/1991 | Mills | 33/760 |

*Primary Examiner*—G. Bradley Bennett
*Attorney, Agent, or Firm*—Brown, Pinnisi & Michaels

[57] ABSTRACT

A T-square for wallboard having a knife-sharpening means mounted on the body of the T-square, allowing the user of the T-square to easily and efficiently sharpen a trimming knife while the T-square is held in operative position on the wallboard. The sharpener may be a simple slot in the T-square, or blades mounted in a "V" formation, or a sharpening stone. The body of the T-square is preferably coated in a fluorescent color coating.

5 Claims, 1 Drawing Sheet

WALLBOARD T-SQUARE WITH SHARPENER

The invention pertains to the field of straightedges for use with wallboard. More particularly, the invention pertains to T-squares having means for sharpening knives for cutting wallboard.

BACKGROUND OF THE INVENTION

Wallboard, also known as Sheetrock® (trademark of U.S. Gypsum), drywall, gypsum board, gypsum panel, gypboard, plasterboard, and gyp-rock, is a sheet material composed of a core of gypsum or other plaster-like material, covered on both sides with heavy paper. In most parts of the United States, this is the most commonly used form of wall construction, in the, form of panels mounted to wooden or metal studs with drywall nails or screws.

Wallboard panels are most often 4' wide and 6', 7', 8', 10', 12', or 16' in length (with 8' the most common). The specialist who installs the drywall in a given room will choose the size which minimizes the need for cutting panels, but the individual wallboard panels still must be cut to fit the space in which they will be mounted to some extent. Cutouts will need to be made for doors, windows, electrical and plumbing connections, and so on.

The most common method of cutting wallboard for these purposes is to use a wallboard T-square, which is a flat aluminum T, usually 22" wide and just over 4' long with appropriate measuring markings, to border the line to be cut. A utility knife (also known as a razor knife, trimming knife, Sheetrock® knife or case knife) scores the drywall along the line of the T-square, and then the drywall can be "snapped" along the line. The paper covering on the opposite side of the board is then cut with the knife.

It is very important that the knife be kept sharp, and at the same time very difficult. A dull knife is inefficient and unsafe. The gypsum filling in drywall, being essentially powdered rock, is very abrasive and tends to dull the knife quickly. In most cases, the knife blade must be discarded and replaced by other razor-type blades, at a continuing expense for new blades and time wasted in changing blades.

SUMMARY OF THE INVENTION

A knife sharpener is added to a drywall T-square, allowing the trimming knife to be sharpened easily and efficiently while the T-square is holding and marking the drywall.

DESCRIPTION OF THE PREFERRED EMBODIMENT

Figure 1:
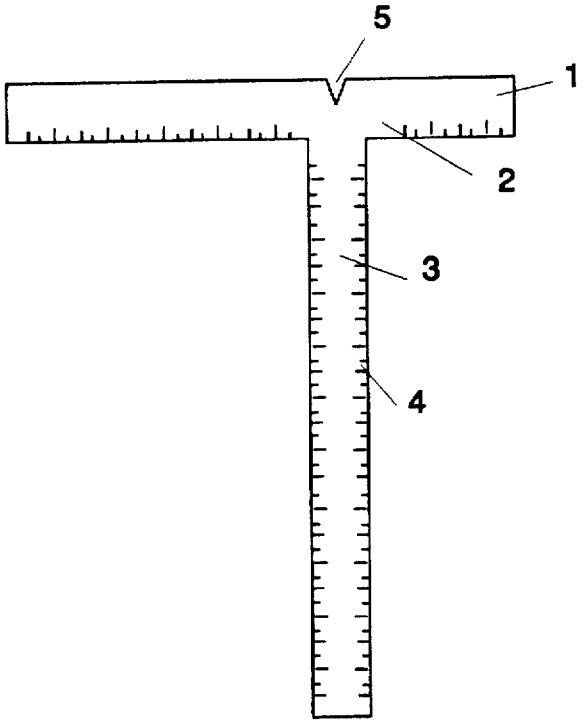
FIG. 1 shows a top view of the T-square of the invention.

FIG. 1 shows an overall view of a drywall T-square (1) built according to the teachings of the invention. The T-square (1) comprises a body made up of two straightedges mounted orthogonally: an upper cross piece (2) with a lower extension (3) descending at right angles. The upper cross piece (2) and lower extension (3) have measurement markings (4), along their lengths, with calibrations at convenient intervals (preferably at least quarter inches). Preferably, both parts of the T-square will be coated with a fluorescent sealer to keep the numbers from wearing off quickly.

Figure 2:
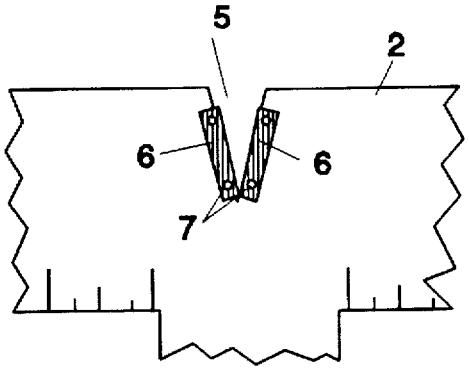
FIG. 2 shows a detail of the T-square of the invention, showing the sharpener inset into the square.

At the top of the upper cross piece (3) is a knife sharpener element (5). This element is preferably formed into a v-shaped groove on the top of the cross piece, as shown in FIGS. 1 and 2. This location allows the user to quickly and easily slide the trimming knife through the sharpener (5) while the T-square is held upright in operative position on the wallboard. In its simplest form, the edges of the groove (5) formed in the body of the T-square can form a sharpening element, if the body is made of a substance which is hard enough to serve such a purpose.

FIG. 2 shows a detail of the cross piece (3) of the T-square (1) from FIG. 1. A V-shaped groove (5) is formed in the edge, and sharpening blades (6) are mounted to the edges of the V-shaped groove with fasteners (7) such as screws, rivets or the like. The fasteners (7) must be flush on the lower side of the T-square, so as not to mar the surface of the wallboard or interfere with the use of the T-square. The sharpening blades (6) can be the kind of thin steel blades which are used in household scissors and knife sharpeners. They are mounted at a correct angle so that the razor knife will be correctly sharpened when it is drawn directly through the V between the blades.

Figure 3:
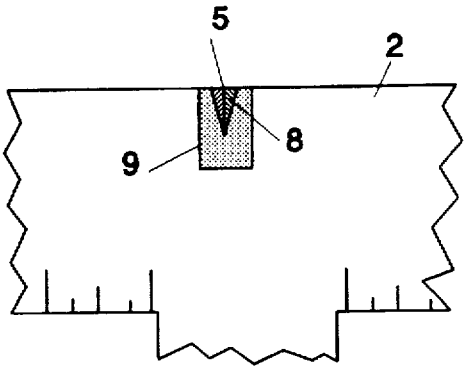
FIG. 3 shows a detail of the T-square of the invention, showing an alternative sharpener mounted on the square.

FIG. 3 shows an alternative embodiment, in which the V-shaped groove (5) is formed into a recess (8) in a sharpening stone (9) mounted on the T-square. The stone can be any convenient kind such as a carborundum or natural ("Arkansas") stone. The "V" groove is formed in the correct angle, so that the knife is sharpened properly when it is drawn straight up the center of the V.

The sharpener is shown in these drawings as being mounted at the intersection of the cross piece and the lower extension, on the upper edge of the cross piece, as is preferred for ease of use. It will be understood, however, it could be mounted at another location, such as at the end of a cross piece or on the centerline of the lower extension, within the teachings of the invention.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

What is claimed is:

1. A wallboard T-square comprising:

a) a generally T-shaped body comprising an upper straightedge having upper and lower edges and a lower straightedge attached orthogonally to the upper straightedge along the lower edge thereof; and b) knife sharpener means for sharpening a blade, mounted on the upper edge of the upper straightedge, such that the knife sharpener can be used when the body is held in an operative position with the upper and lower straightedges held flat against a sheet of wallboard.

2. The wallboard T-square of claim 1 in which the knife sharpener means comprises a V-shaped groove in the upper edge of the upper straightedge.

3. The wallboard T-square of claim 2 in which the knife sharpener means further comprises a plurality of blade means mounted on the inner edges of the V-shaped groove, the blade means meeting at the acute angle of the V-shaped groove an angle such that a knife blade drawn between the blade means will be sharpened.

4. The wallboard T-square of claim 1 in which the knife sharpener means comprises a sharpening stone mounted on the upper straightedge, adjacent to the upper edge thereof.

5. The wallboard T-square of claim 1 in which the body of the T-square is coated with a fluorescent coating.

* * * * *